US011112163B2

(12) United States Patent
Galea et al.

(10) Patent No.: US 11,112,163 B2
(45) Date of Patent: Sep. 7, 2021

(54) ICE-MAKING COMPARTMENT FOR AN APPLIANCE

(71) Applicant: WHIRLPOOL CORPORATION, Benton Harbor, MI (US)

(72) Inventors: Sarah M. Galea, St. Joseph, MI (US); Jacob C. Ickes, Stevensville, MI (US); Vikas C. Mruthyunjaya, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 174 days.

(21) Appl. No.: 16/251,141

(22) Filed: Jan. 18, 2019

(65) Prior Publication Data

US 2020/0232697 A1 Jul. 23, 2020

(51) Int. Cl.

| | |
|---|---|
| ***F25D 17/06*** | (2006.01) |
| ***F25C 5/20*** | (2018.01) |
| ***F25C 1/24*** | (2018.01) |
| ***F25C 5/182*** | (2018.01) |
| ***F25D 17/08*** | (2006.01) |

(52) U.S. Cl.

CPC ..... *F25D 17/067* (2013.01); *F25C 1/24* (2013.01); *F25C 5/182* (2013.01); *F25C 5/22* (2018.01); *F25D 17/065* (2013.01); *F25D 17/08* (2013.01); *F25C 2400/06* (2013.01); *F25C 2400/10* (2013.01); *F25D 2317/0654* (2013.01); *F25D 2317/0665* (2013.01); *F25D 2600/04* (2013.01)

(58) Field of Classification Search

CPC ..... F25D 17/065; F25D 2317/063

See application file for complete search history.

(56) References Cited

U.S. PATENT DOCUMENTS

| | | | | |
|---|---|---|---|---|
| 8,281,613 | B2 | 10/2012 | An et al. | |
| 8,671,711 | B2 | 3/2014 | Kim | |
| 8,943,852 | B2 * | 2/2015 | Lee | F25D 17/062 62/420 |
| 9,217,595 | B2 | 12/2015 | Kim et al. | |
| 9,568,232 | B2 | 2/2017 | Kim et al. | |

(Continued)

FOREIGN PATENT DOCUMENTS

| | | | |
|---|---|---|---|
| EP | 3239629 | A1 | 11/2017 |
| EP | 3483534 | A1 | 5/2019 |

(Continued)

*Primary Examiner* — Christopher R Zerphey

(74) *Attorney, Agent, or Firm* — Price Heneveld LLP

(57) ABSTRACT

A refrigerator includes a cabinet and a refrigeration system having an evaporator. An ice-making compartment is positioned within the cabinet and includes a housing defining an inlet aperture on an upper portion of the housing and an outlet aperture. An ice storage bin is positioned in a lower portion of the housing. An ice tray is positioned above the ice storage bin. An inlet duct is in fluid communication with the inlet aperture and is configured to direct air into the housing from the evaporator. The inlet duct includes a first branch having a plurality of first branch channels to direct air to a plurality of first branch locations on a first surface of the ice tray. A second branch of the inlet duct directs air to a second surface of the ice tray. An outlet duct is in fluid communication with the outlet aperture and is configured to direct air from the housing to the evaporator.

16 Claims, 6 Drawing Sheets

(56) References Cited

U.S. PATENT DOCUMENTS

| | | | | |
|---|---|---|---|---|
| 9,829,235 | B2 * | 11/2017 | Visin | F25C 1/246 |
| 9,857,121 | B2 * | 1/2018 | Yang | F25C 5/08 |
| 9,879,896 | B2 * | 1/2018 | Koo | F25D 17/065 |
| 10,101,074 | B2 * | 10/2018 | Morgan | F25C 5/06 |
| 10,156,394 | B2 * | 12/2018 | Mitchell | F25C 5/08 |
| 2005/0241329 | A1 | 11/2005 | Castrellon | |
| 2008/0034780 | A1 * | 2/2008 | Lim | F25D 17/065 62/353 |
| 2015/0308725 | A1 | 10/2015 | Friedmann et al. | |
| 2016/0116199 | A1 | 4/2016 | Fischer et al. | |
| 2018/0112903 | A1 * | 4/2018 | Celik | F25D 17/065 |
| 2018/0238600 | A1 | 8/2018 | Lee et al. | |

FOREIGN PATENT DOCUMENTS

| | | |
|---|---|---|
| JP | S5640368 | 4/1981 |
| TW | 201303242 A | 1/2013 |

* cited by examiner

ICE-MAKING COMPARTMENT FOR AN APPLIANCE

FIELD OF DISCLOSURE

The present disclosure generally relates to an ice-making compartment and, more particularly, to a refrigerator ice-making compartment for improving airflow.

BACKGROUND

Airflow within an ice-making compartment may be utilized for freezing water within an ice tray. Air may enter the ice-making compartment via an inlet. Airflow may not be uniform over the ice tray based on the location of the ice tray relative to the inlet.

SUMMARY

In at least one aspect of the present disclosure, a refrigerator includes a cabinet and a refrigeration system having an evaporator. An ice-making compartment is positioned within the cabinet and includes a housing defining an inlet aperture on an upper portion of the housing and an outlet aperture. An ice storage bin is positioned in a lower portion of the housing. An ice tray is positioned in the upper portion of the housing and over the ice storage bin. An inlet duct is in fluid communication with the inlet aperture and is configured to direct air into the housing from the evaporator. The inlet duct includes a first branch having a plurality of first branch channels to direct air to a plurality of first branch locations on a first surface of the ice tray. A second branch of the inlet duct directs air to a second surface of the ice tray. An outlet duct is in fluid communication with the outlet aperture and is configured to direct air from the housing to the evaporator.

In at least another aspect of the present disclosure, an ice-making compartment for an appliance includes a housing defining an inlet aperture and an outlet aperture. An outlet duct is in fluid communication with the outlet aperture and is configured to direct air into the housing. An inlet duct is in fluid communication with the inlet aperture and is configured to direct air into the housing. Staggered ice trays are positioned at varying heights within an interior of the housing and the inlet duct directs air to each of the staggered ice trays.

In at least another aspect of the present disclosure, an ice-making compartment for an appliance includes a housing defining an inlet aperture and an outlet aperture. An ice tray is positioned within the housing. An inlet duct is in fluid communication with the inlet aperture and the inlet aperture is positioned at a first height on a first sidewall of the housing. An outlet duct is in fluid communication with the outlet aperture and the outlet aperture is positioned at a second height on a second sidewall of the housing. A deflector is positioned in an upper portion of the housing opposing the inlet duct and the deflector redirects air from a first surface of the ice tray to a second surface of the ice tray.

These and other features, advantages, and objects of the present device will be further understood and appreciated by those skilled in the art upon studying the following specification, claims, and appended drawings.

DETAILED DESCRIPTION OF EMBODIMENTS

Figure 1:
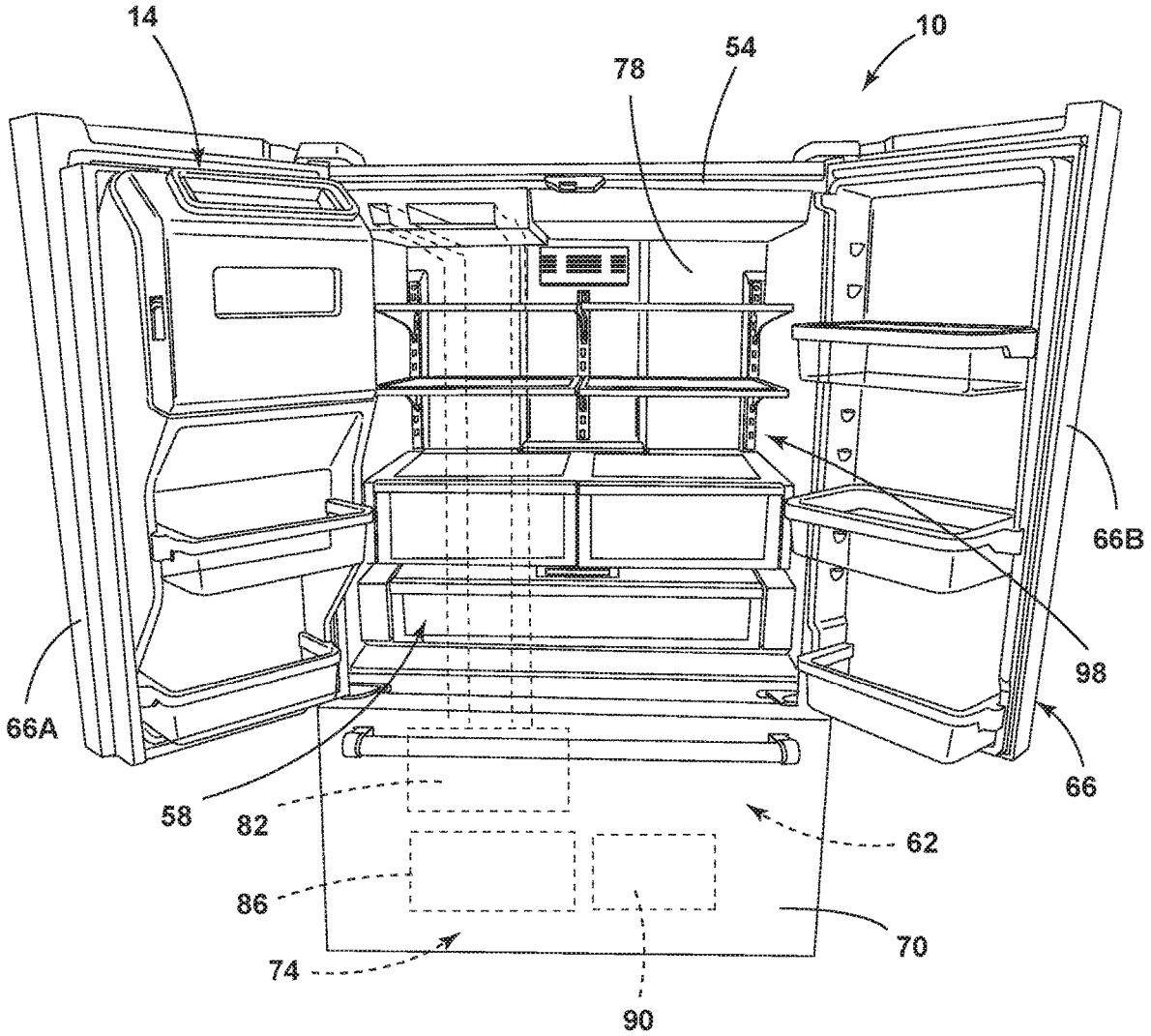
FIG. 1 is a front perspective view of a refrigerator having an ice-making compartment, according to at least one example.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIGS. 1-8, reference numeral 10 generally designates a refrigerator including an ice-making compartment 14. The ice-making compartment 14 includes a housing 18 defining an inlet aperture 22 and an outlet aperture 26. An inlet duct 30 is in fluid communication with the inlet aperture 22 to direct incoming air 34 into the housing 18. An outlet duct 38 is in fluid communication with the outlet aperture 26 to direct the outgoing air 42 out of the housing 18. Additionally, an ice tray 46 may be positioned within an interior 50 of the housing 18.

Referring to FIG. 1, the illustrated refrigerator 10 has a cabinet 54. The refrigerator includes a refrigerator compartment 58 and/or a freezer compartment 62. The refrigerator 10 includes a refrigerator compartment door 66 proximate the refrigerator compartment 58 and a freezer compartment door 70 proximate the freezer compartment 62. The refrigerator 10 depicted in FIG. 1 shows the refrigerator compartment 58 having left and right refrigerator compartment doors 66A, 66B for a French-door style refrigerator compartment 58. Additionally, the refrigerator 10 depicted in FIG. 1 shows the freezer compartment 62 positioned below the refrigerator compartment 58. It will be contemplated that the refrigerator 10 may include other styles of refrigerators such as, for example, side-by-side refrigerators or single door refrigerator compartments.

With further reference to FIG. 1, the refrigerator 10 includes a refrigeration system 74. The refrigeration system 74 may be positioned in the refrigerator compartment 58 or in the freezer compartment 62. The refrigeration system 74 may also be positioned proximate a rear wall 78 of the refrigerator 10. The refrigerator system 74 includes an evaporator 82, a condenser 86, and a compressor 90. The ice-making compartment 14 of FIG. 1 is shown positioned within the refrigerator compartment door 66. The ice-making compartment 14 may be positioned within the interior 98 of the cabinet 54, within the refrigerator compartment door 66, or the freezer compartment door 70. However, it will be contemplated that the ice-making compartment 14 may be positioned in the freezer compartment 62 or other locations within the refrigerator 10 without deviating from the teachings herein.

Figure 2:
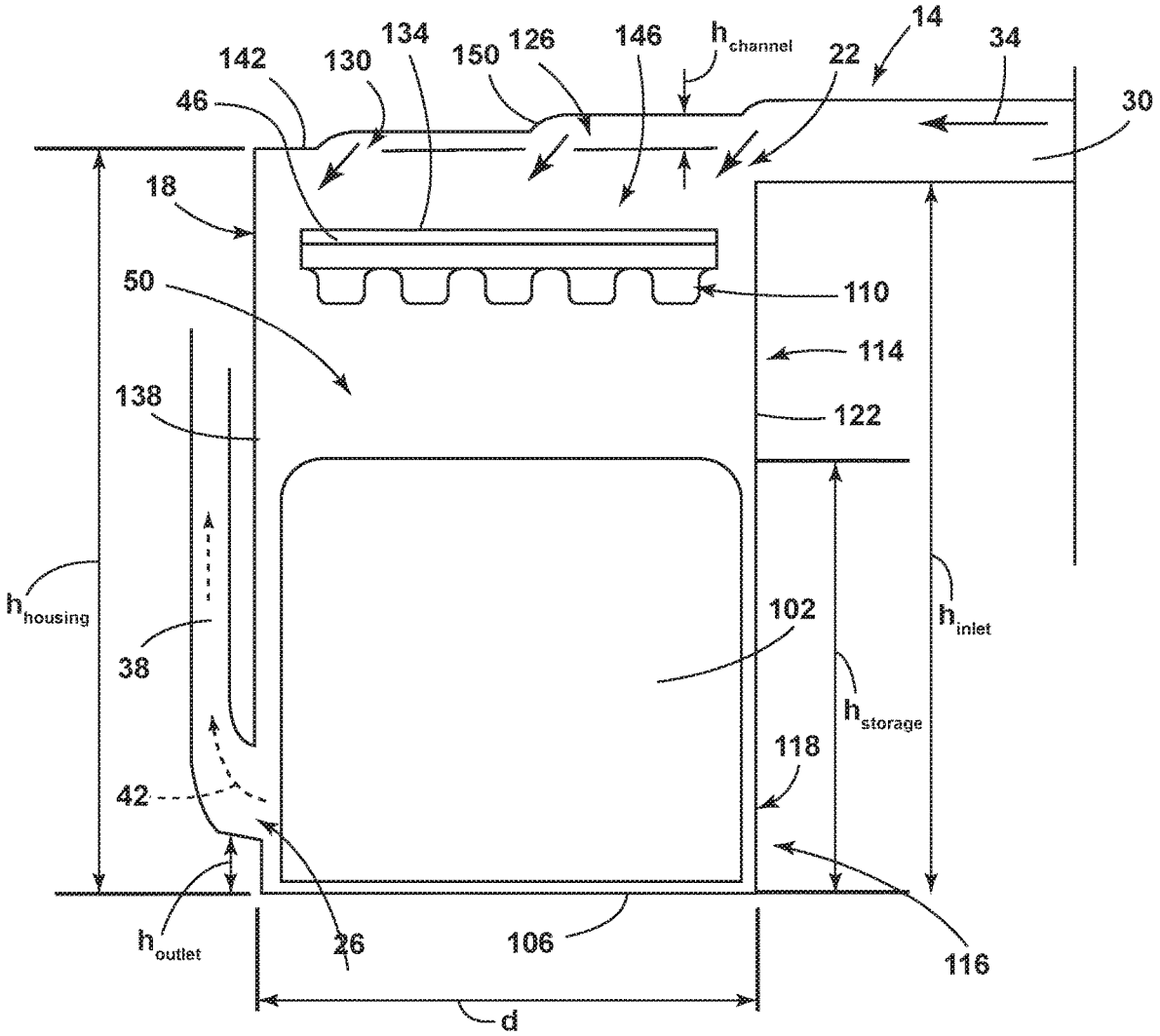
FIG. 2 is a side schematic view of the ice-making compartment including an inlet duct having a first branch, according to at least one example.

Referring now to FIG. 2, an ice storage bin 102 may be positioned within the housing 18 of the ice-making compartment 14. The ice storage bin 102 is shown positioned on a bottom wall 106 of the housing 18. The ice storage bin 102 may also include an ice grinder area. In various examples, the ice storage bin 102 has a height $h_{storage}$ in a range of from approximately 150 mm to approximately 200 mm. The width and depth of the ice storage bin 102 may be substantially similar to the width w and depth d of the housing 18. As illustrated, the ice-making compartment 14 includes an ice tray 46 positioned in the housing 18. The ice tray 46 defines more than one ice cube cavity 110. However, the ice tray 46 may define multiple ice cube cavities 110. In various examples, the ice tray 46 is positioned in an upper portion 114 of the housing 18 and positioned above the ice storage bin 102. However, the ice tray 46 may be positioned in other locations within the housing 18. The ice tray 46 may be coupled to at least one sidewall 118 of the housing 18.

In various examples, the housing 18 has a height $h_{storage}$ in a range of from approximately 250 mm to approximately 300 mm. The housing 18 has a depth d in a range of from approximately 130 mm to approximately 180 mm. Additionally, the housing 18 has a width w (i.e., extend into the paper) in a range of from approximately 250 mm to approximately 300 mm. The housing 18 defines the inlet aperture 22 and the outlet aperture 26. As illustrated, the inlet aperture 22 is positioned in the upper portion 114 of the housing 18 and the outlet aperture 26 is positioned in a lower portion 116 of the housing 18. In other words, the inlet aperture 22 may be positioned at a first height $h_{inlet}$ and the outlet aperture 26 may be positioned at a second height $h_{outlet}$ the first height $h_{inlet}$ may be above the second height $h_{outlet}$. The outlet aperture 26 may also be positioned proximate the ice storage bin 102. It may be advantageous to have the outlet aperture 26 positioned proximate the ice storage bin 102 to direct incoming air 34 through the ice storage bin 102 before the outgoing air 42 exits the housing 18 through the outlet aperture 26.

Still referring to FIG. 2, the inlet duct 30 is in fluid communication with the inlet aperture 22 and configured to direct the incoming air 34 into the housing 18 from the evaporator 82 (FIG. 1). Accordingly, the inlet duct 30 is positioned at the first height $h_{inlet}$, which is illustrated as being within the upper portion 114 of the housing 18. The inlet duct 30 is coupled to a first sidewall 122 of the housing 18. The first sidewall 122 may be, for example, a front side, a rear side, or a lateral side of the housing 18. In the depicted example, the first sidewall 122 is illustrated as a rear side of the ice-making compartment 14. The inlet aperture 22 and inlet duct 30 may be positioned to direct the incoming air 34 to the ice tray 46 positioned within the housing 18.

As illustrated, the inlet duct 30 includes a first branch 126 where the first branch 126 has a plurality channels 130, for example a plurality of first branch channels. The channels 130 assist in directing the incoming air 34 to a plurality of locations, such as, for example, a plurality of first branch locations, on a first surface 134 of the ice tray 46. The first surface 134 of the ice tray 46 may be a top surface, a bottom surface, or other side surface of the ice tray 46. In the depicted example, the first surface 134 is shown as a top surface of the ice tray 46. The channels 130 may be oriented within the housing 18 to direct the incoming air 34 air from the inlet duct 30 to more than one ice cube cavity 110 within the ice tray 46. The channels 130 may also direct the incoming air 34 to each ice cube cavity 110 within the ice tray 46. It may be advantageous to include the channels 130 to improve airflow distribution across the ice tray 46 and thereby increase ice rates through more balanced distribution of the incoming air 34.

Referring still to FIG. 2, the outlet duct 38 is in fluid communication with the outlet aperture 26 and configured to direct outgoing air 42 from the interior 50 of the housing 18 to the evaporator 82 (FIG. 1). As illustrated, the outlet aperture 26 and the outlet duct 38 are positioned at the second height $h_{outlet}$ of the housing 18. The second height $h_{outlet}$ is positioned closer to the bottom wall 106 of the housing 18 compared to the first height $h_{inlet}$ of the inlet aperture 22 and inlet duct 30. In various examples, the inlet duct 30 may be coupled to the first sidewall 122 of the housing 18 and the outlet duct 38 may be coupled to a second sidewall 138 of the housing 18 where the second sidewall 138 opposes the first sidewall 122. Accordingly, the inlet and outlet apertures 22, 26 may be defined by opposing first and second sidewalls 122, 138 of the housing 18.

As illustrated in FIG. 2, the housing 18 includes a stepped top wall 142. In such examples, a space 146 between the stepped top wall 142 and the ice tray 46 decreases with each step 150. The stepped top wall 142 includes more than one step 150. The stepped top wall 142 may also include multiple steps 150. The steps 150 of the stepped top wall 142 may correspond with and/or align with the channels 130 of the inlet duct 30. For example, the space 146 between the stepped top wall 142 and the ice tray 46 decreases with the step 150 at a point where the channel 130 directs the incoming air 34 towards the ice tray 46. It may be advantageous to align the steps 150 with the channels 130 to improve airflow through the channels 130 to the ice tray 46. Further, a height $h_{channel}$ of the channels 130 may decrease with each step 150. As such, the height $h_{channel}$ of proximate the inlet duct 30 is greater than the height $h_{channel}$ proximate a sidewall 118 positioned opposite the inlet duct 30. The decreasing height $h_{channel}$ may be advantageous to improve airflow through the channels 130 farther from the inlet duct 30 to provide more even incoming air 34 across the ice tray 46.

Figure 3:
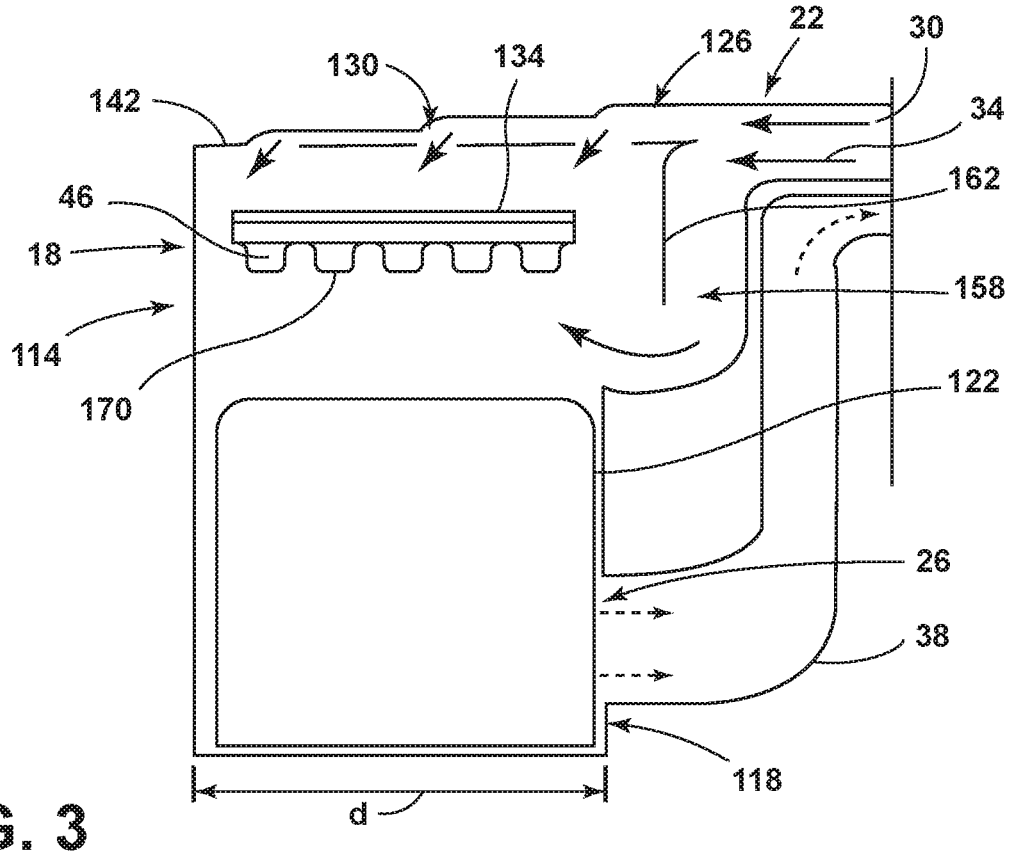
FIG. 3 is a side schematic view of the ice-making compartment including the inlet duct having the first branch and a second branch, according to at least one example.

Referring now to FIG. 3, the inlet duct 30 is illustrated having more than one branch 126 to direct incoming air 34 to the ice tray 46. For example, the inlet duct 30 includes the first branch 126 and a second branch 158. In the depicted example, the first branch 126 is shown as an upper branch and the second branch 158 is shown as a lower branch. The first branch 126 may extend along the stepped top wall 142 of the housing 18 and include the channels 130. The second branch 158 may extend downward from the inlet aperture 22. A dividing wall 162 is positioned within the housing 18 to divide the first branch 126 from the second branch 158. In examples including the first and second branches 126, 158 of the inlet duct 30, the upper portion 114 of the housing 18 may have a greater depth d than the lower portion 116 of the housing 18 to accommodate the second branch 158. The first branch 126 directs incoming air 34 to the first surface 134 of the ice tray 46. The second branch 158 directs incoming air 34 to a second surface 170 of the ice tray 46. In various examples, the first surface 134 of the ice tray 46 may be the top surface and the second surface 170 may be the bottom surface of the ice tray 46 such that the channels 130 may direct the incoming air 34 to the plurality locations on the top surface of the ice tray 46. It will also be contemplated that the first branch 126 may not include the channels 130.

Figure 4:
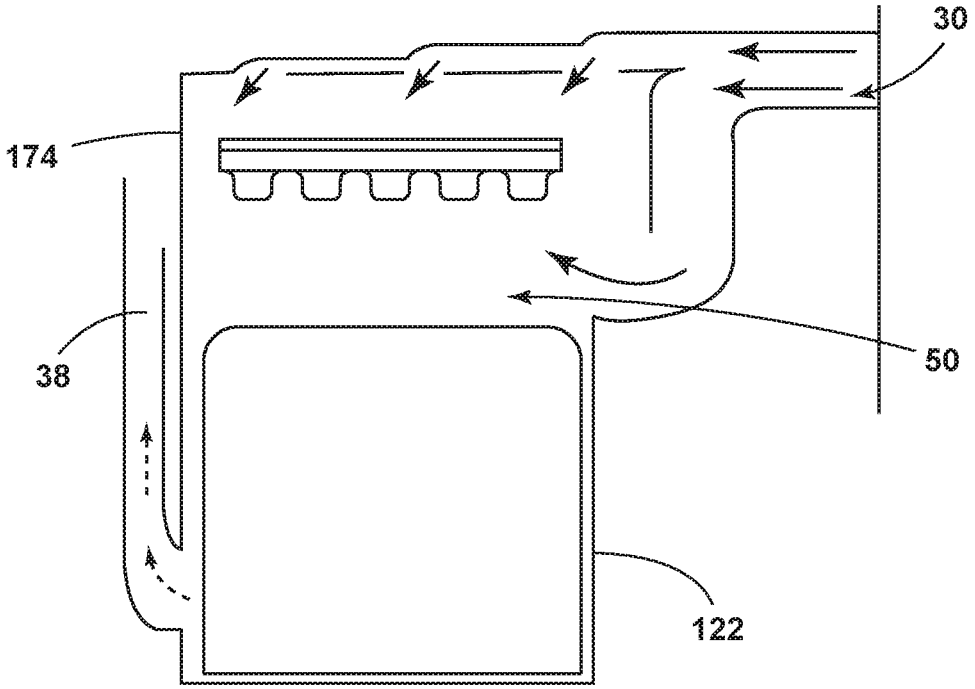
FIG. 4 is a side schematic view of the ice-making compartment with the inlet duct and an outlet duct coupled to opposing sidewalls of a housing, according to at least one example.

Referring now to FIGS. 3 and 4, the outlet aperture 26 may be positioned on various sidewalls 118 of the housing 18. As shown in FIG. 3, the inlet aperture 22 and the outlet aperture 26 are both defined by the first sidewall 122 of the housing 18. Accordingly, the inlet duct 30 and the outlet duct 38 are both coupled to the first sidewall 122. Alternatively, as shown in FIG. 4, the inlet duct 30 is defined by the first sidewall 122 and the outlet duct 38 is defined by the opposing second wall 174. The orientation of the inlet and outlet apertures 22, 26 may be determined by the desired airflow and/or cross-airflow within the interior 50 of the housing 18. It will be understood that the outlet aperture 26 may be defined by the first sidewall 122 or the second sidewall 138 with each of the inlet duct 30 configurations without deviating from the teachings herein.

Figure 5:
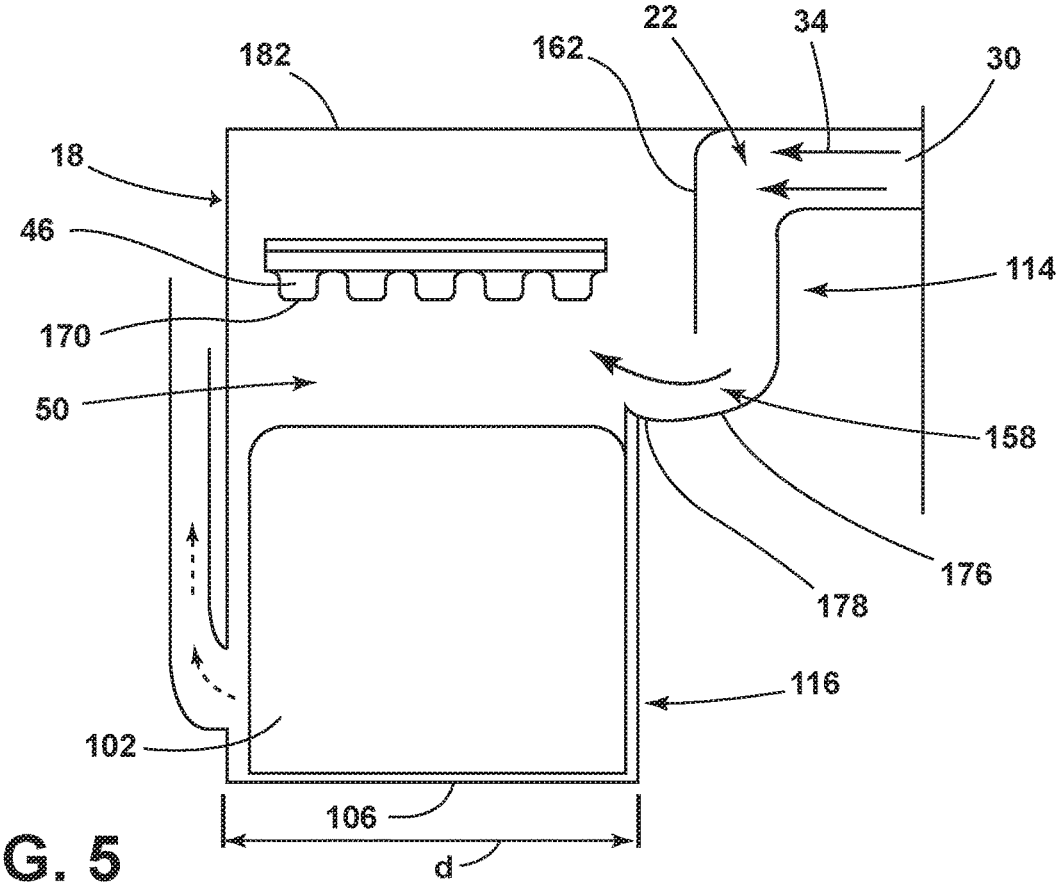
FIG. 5 is a side schematic view of the ice-making compartment including the inlet duct having the second branch, according to at least one example.

Referring now to FIG. 5, as illustrated, the inlet duct 30 includes the second branch 158 where the second branch 158 directs incoming air 34 to the second surface 170 (e.g., the bottom surface) of the ice tray 46. In such examples, the ice-making compartment 14 does not include the first branch 126 to direct the incoming air 34 to the first surface 134 (e.g., the top surface) of the ice tray as shown in FIG. 3. Referring still to FIG. 5, the second branch 158 may extend downwards towards the bottom wall 106 of the housing 18 from the inlet aperture 22 and open towards the interior 50 of the housing 18. In such examples, the upper portion 114 of the housing 18 may have a greater depth d compared to the lower portion 116 of the housing 18. As illustrated, a bottom 176 of the second branch 158 is rounded such that the incoming air 34 is guided into the interior 50 of the housing 18. An interior edge portion 178 of the bottom 176 of the second branch 158 extends upwards from the bottom 176 to assist in guiding the incoming air 34 to the ice tray 46 instead of towards the ice storage bin 102. The dividing wall 162 may also be included to separate the second branch 158 from the interior 50 of the housing 18 to direct the incoming air 34 downwards in the second branch 158. Additionally, as illustrated in FIG. 5, the housing 18 includes a flat top wall 182 such that the flat top wall 182 does not include the steps 150 shown in FIG. 2. Referring still to FIG. 5, the flat top wall 182 may be advantageous for improved airflow and/or cross-airflow within the interior 50 of the housing 18 based on the configuration of the inlet duct 30. It will be understood that either the stepped top wall 142 (FIG. 2) or the flat top wall 182 may be utilized for each of the inlet duct 30 configurations without deviating from the teachings herein.

Figure 6:
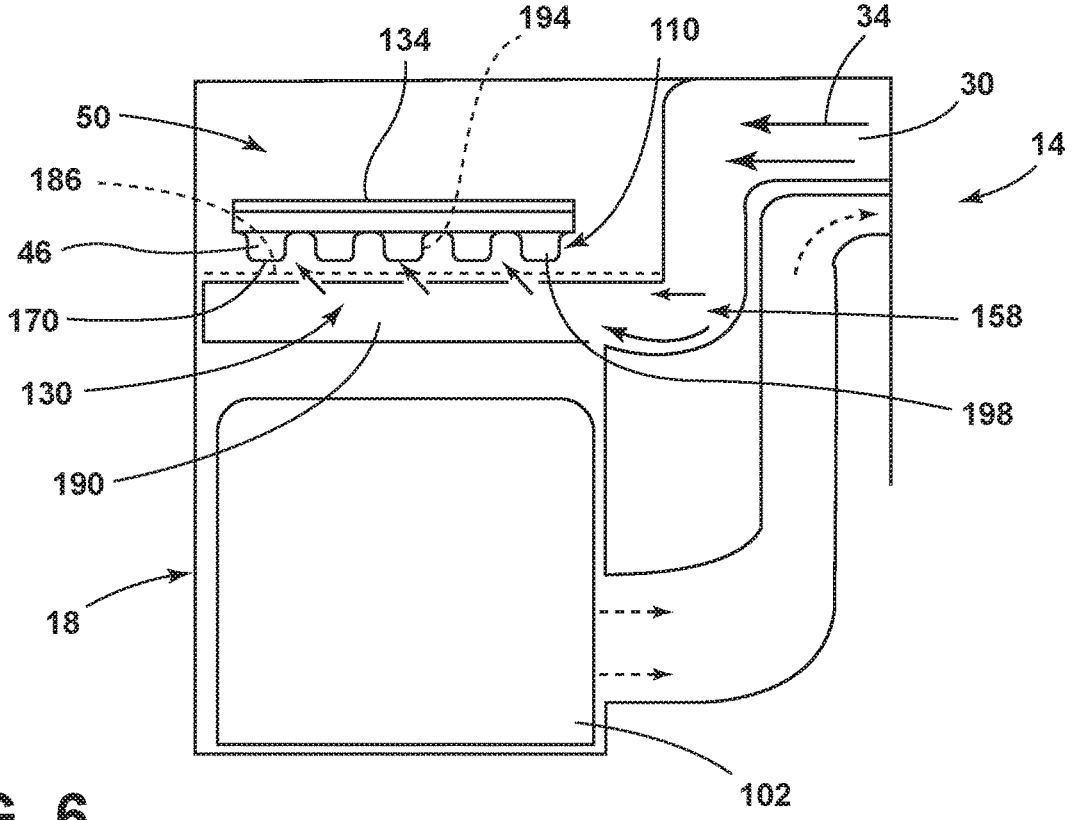
FIG. 6 is a side schematic view of the ice-making compartment including the inlet duct having the second branch with left and right portions extending proximate left and right sides of an ice tray, according to at least one example.

Referring now to FIG. 6, as illustrated, the second branch 158 included a plurality of channels 130, for example a plurality of second branch channels. The second branch 158 extends under the ice tray 46 and includes the channels 130 to direct incoming air 34 to a plurality locations, such as, for example, a plurality of second branch locations, on the second surface 170 of the ice tray 46. The channels 130 may direct the incoming air 34 to the second surface 170 (e.g., the bottom surface) of each ice cube cavity 110 within the ice tray 46. In various examples, the second branch 158 may divide into a left section 186 and a right section 190. The left and right sections 186, 190 extend into the interior 50 of the housing 18 proximate left and right side surfaces 194, 198 of the ice tray 46, respectively. Each of the left and right sections 186, 190 may include the channels 130 for directing the incoming air 34 towards the ice tray 46. It may be advantageous to include the left and right sections 186, 190 to improve airflow to the entire ice tray 46 without substantially interfering with the ice-making process (i.e., ice cubes moving from the ice tray 46 to the ice storage bin 102).

In various examples, the ice-making compartment 14 may include the second branch 158 having the left and right sections 186, 190 with the channels 130 and the first branch 126 (FIG. 2). The incoming air 34 may then be directed to both the first and second surfaces 134, 170 of the ice tray 46. For example, the incoming air 34 may be directed to a plurality of locations on the first surface 134 of the ice tray 46, the second surface 170 of the ice tray 46, or both the first and second surfaces 134, 170 of the ice tray 46 depending on the configuration of the first and second branches 126, 158 of the inlet duct 30.

Figure 7:
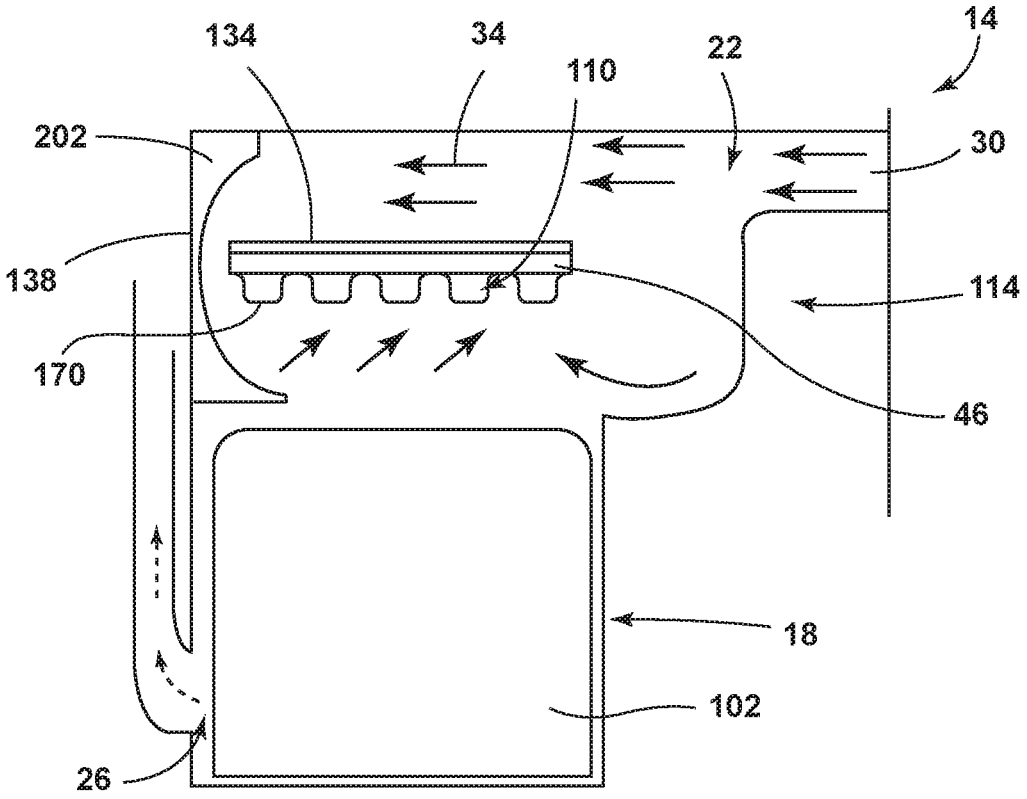
FIG. 7 is a side schematic view of the ice-making compartment including a deflector, according to at least one example.

Referring now to FIG. 7, as illustrated, the ice-making compartment 14 also includes a deflector 202 positioned within the housing 18. The deflector 202 is shown positioned in the upper portion 114 of the housing 18 opposing the inlet aperture 22 and inlet duct 30. The deflector may be coupled to the second sidewall 138 of the housing 18. However, the deflector 202 may be integrally formed with the housing 18. The deflector 202 operates to redirect the incoming air 34 to the second surface 170 of the ice tray 46. In other words, the deflector 202 operates to redirect the incoming air 34 from first surface 134 of the ice tray 46 to the second surface 170 of the ice tray 46. It will be understood that the deflector 202 may redirect the incoming air 34 from the top surface to the bottom surface of the ice tray 46 based on the configuration of the inlet duct 30. It will also be understood that deflector 202 may redirect the incoming air 34 from the bottom surface to the top surface of the ice tray 46 based on the configuration of the inlet duct 30. In various examples, the deflector 202 forms an arcuate shape. The deflector 202 may also form a hemispherical shape, a substantially symmetrical concave shape, or a C-shape. However, it will be contemplated that the deflector 202 may form another shape such as, for example, a convex shape or an asymmetrical concave shape depending on the desired direction of the deflected incoming air 34.

As illustrated, the deflector 202 extends past at least one ice-cube cavity 110 of the ice tray 46. However, the defector 202 may not extend past an ice cube cavity 110 or may extend past multiple ice cube cavities 110 based on the desired path for redirecting the incoming air 34. The deflector 202 may also be adjustable to improve and/or maximize airflow to the second surface 170 of the ice tray 46. The deflector 202 may be adjustable by, for example, changing the shape of the deflector 202 and/or changing the angle of the deflector 202 within the housing 18. In operation, the incoming air 34 exits the inlet duct 30 through the inlet aperture 22 and flows over the first surface 134 of the ice tray 46. The incoming air 34 comes into contact with the deflector 202 and then is redirected by the deflector 202 to flow over the second surface 170 of the ice tray 46. The incoming air 34 may then travel through the ice storage bin 102 and through the outlet aperture 26. Use of the deflector 202 may be advantageous to maximize the surface area of the ice tray 46 exposed to the incoming air 34 and thereby maximize the efficiency of the use of the incoming air 34.

Figure 8:
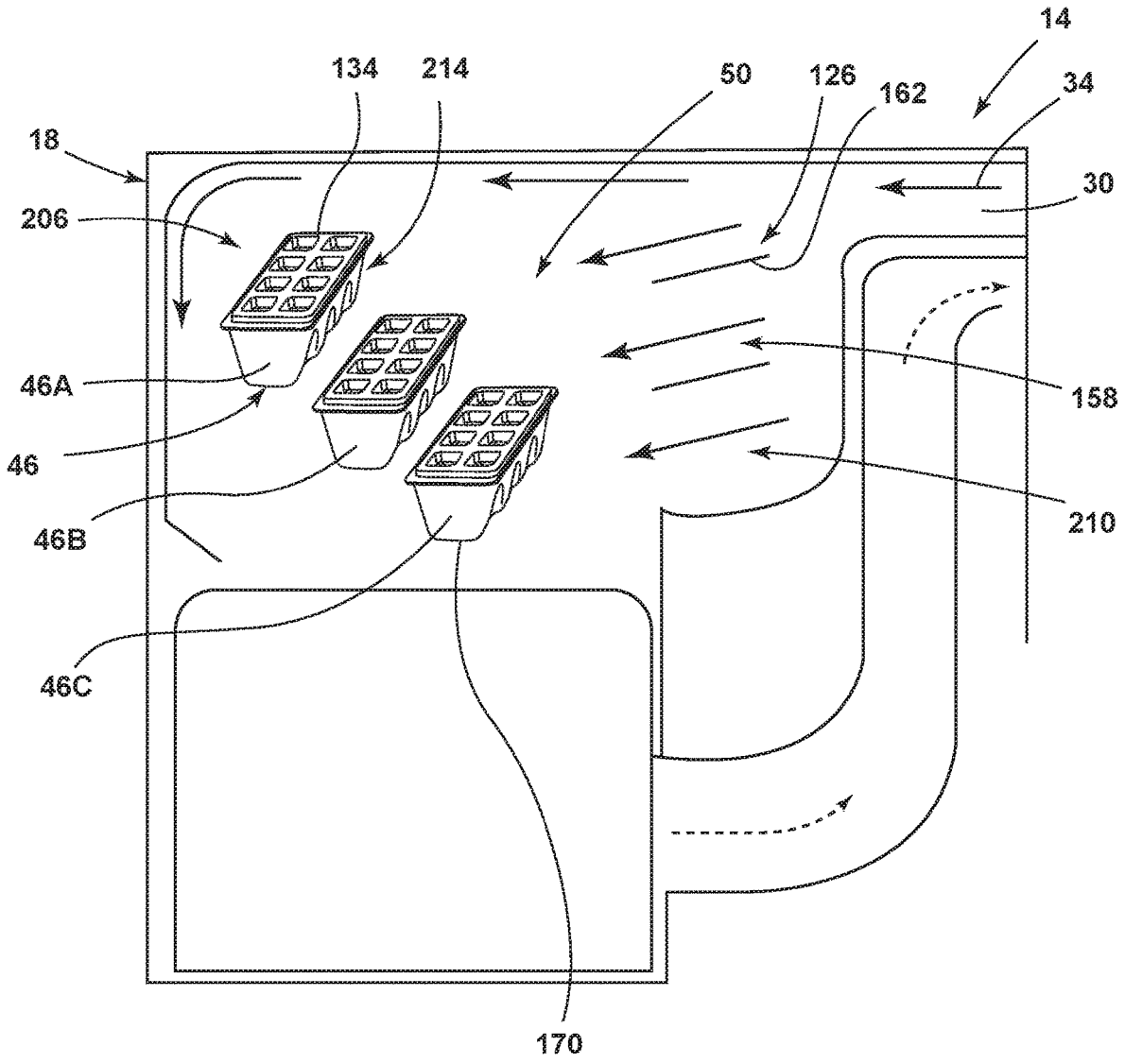
FIG. 8 is a side schematic view of the ice-making compartment including staggered ice trays, according to at least one example.

Referring now to FIG. 8, the ice-making compartment 14 is illustrated including staggered ice trays 206. The staggered ice trays 206 include more than one ice tray 46 positioned at varying heights within the interior 50 of the housing 18. The ice trays 46 are spaced apart such that incoming air 34 may flow between the ice trays 46. The inlet duct 30 may direct the incoming air 34 to each of the ice trays 46. In various examples, the inlet duct 30 may include more than one branch 126 to direct the incoming air 34. For example, the inlet duct 30 includes the first branch 126, the second branch 158, and a third branch 210 directing the incoming air 34 into the interior 50 of the housing 18. As illustrated, the first, second, and third branches 126, 158, 210 are stacked vertically such that the first branch 126 is higher than the second branch 158, which is higher than the third branch 210. At least one dividing wall 162 is included to direct the incoming air 34 to the various locations of the staggered ice trays 206. The varying heights of the first, second, and third branches 126, 158, 210 of the inlet duct 30 may correspond with and/or align with the varying heights of the staggered ice trays 206. Accordingly, the inlet duct 30 directs the incoming air 34 to at least one surface 214 of each of the staggered ice trays 206. The first, second, and third branches 126, 158, 210 may be oriented to direct the incoming air 34 to a first ice tray 46A, a second ice tray 46B, and a third ice tray 46C of the staggered ice trays 206, respectively. The first, second, and third ice trays 46A-C are shown as an upper ice tray, a middle ice tray, and a lower ice tray, respectively. The first, second, and third branches 126, 158, 210 may be configured to direct air to the first surface 134 (e.g., the top surface) of each of the ice trays 46. However, the first, second, and third branches 126, 158, 210 may be configured to direct air to the second surface 170 (e.g., the bottom surface) of each of the ice trays 46. In other words, the inlet duct 30 may direct air to at least one of the top and bottom surfaces of each of the staggered ice trays 206. It will also be contemplated than fewer or more ice trays 46 may be included within the staggered ice tray 206.

In various examples, the staggered ice trays 206 includes at least two ice trays 46 spaced at different heights within the housing 18 to have the first and second ice trays 46A, 46B (e.g., upper and lower ice trays). In such examples, the inlet duct 30 directs the incoming air 34 between the ice trays 46 such that the incoming air 34 is directed at the second surface 170 of the first ice tray 46A and the first surface 134 of the second ice tray 46B. In other words, the incoming air 34 may be directed at the bottom surface of the upper ice tray and the top surface of the lower ice tray. Use of the staggered ice trays 206 may be advantageous to improve airflow and/or cross airflow within the housing 18 and across the ice trays 46.

According to at least one aspect, a refrigerator includes a cabinet and a refrigeration system including an evaporator. An ice-making compartment may be positioned within the cabinet. The ice-making compartment includes a housing defining an inlet aperture and an upper portion of the housing and an outlet aperture. An ice storage bin may be positioned in a lower portion of the housing. An ice tray may be positioned above the ice storage bin. An inlet duct may be in fluid communication with the inlet aperture and may be configured to direct air into the housing from the evaporator. The inlet duct may include a first branch having a plurality of first branch channels to direct air to a plurality of first branch locations on a first surface of the ice tray and a second branch to direct air to a second surface of the ice tray. An outlet duct may be in fluid communication with the outlet aperture and may be configured to direct air from the housing to the evaporator.

According to another aspect, the first surface of the ice tray may be a top surface and the second surface of the ice tray may be a bottom surface. The panels may direct air to the plurality of first branch locations on the top surface.

According to another aspect, the first surface of the ice tray may be a bottom surface and the second surface of the ice tray may be a top surface. The plurality of first branch channels may direct air to the plurality of first branch locations on the bottom surface.

According to still another aspect, the second branch of the inlet duct may include a plurality of second branch channels to direct air to a plurality of second branch locations on the second surface of the ice tray.

According to another aspect, the inlet and outlet apertures may be defined by opposing sidewalls of the housing.

According to yet another aspect, the plurality of first branch channels may be oriented within the housing to direct air from the inlet duct each ice cube cavity within the ice tray.

According to another aspect, the housing may include a stepped top wall. A space between the stepped top wall and the ice bay may decrease with each step.

According to another aspect, the steps of the stepped top wall may align with the plurality of first branch channels of the inlet duct.

According to at least one aspect, and ice-making compartment for an appliance may include a housing defining an inlet aperture and an outlet aperture. An outlet duct may be in fluid communication with the outlet aperture and may be configured to direct air out of the housing. In inlet duct may be in fluid communication with the inlet aperture and may be configured to direct air into the housing. Staggered ice trays may be positioned at various heights within an interior of the housing. The inlet duct may direct air to each of the staggered ice trays.

According to another aspect, the inlet duct may include more than one branch to direct air each of the staggered ice trays.

According to another aspect, the branches of the inlet duct may be stacked vertically to align with the varying heights of the staggered ice trays.

According to still another aspect, the inlet duct may direct air to at least one of a top and bottom surface of each of the staggered ice trays.

According to another aspect, a deflector may be positioned in an upper portion of the housing opposing the inlet duct.

According to yet another aspect, the staggered ice trays may include at least two ice trays. The inlet duct may direct air between the two ice trays such that the air may be directed at a bottom surface of the first ice tray and a top surface of the second ice tray.

According to at least one aspect, and ice-making compartment for an appliance may include housing defining an inlet publisher and an outlet aperture. An ice tray may be positioned within the housing. The inlet duct may be in fluid communication with the inlet aperture. The inlet aperture may be positioned at a first height on a first surface of the housing direct air to the ice tray. An outlet duct may be in fluid communication with outlet aperture. The outlet aperture may be positioned on a second height on a second surface of the housing. An arcuate deflector may be positioned in an upper portion of the housing opposing the inlet duct. The arcuate deflector may direct air from a first surface is ice tray to a second surface of ice tray.

According to another aspect, the second height may be lower than the first height and may be proximate an ice storage bin to direct air through the ice storage been before exiting housing through the outlet duct.

According to another aspect, the housing may include a stepped top wall.

According to still another aspect, the first surface may be a top surface of the ice tray and the second surface may be a bottom surface of ice tray.

According to another aspect, the arcuate deflector may be adjustable to maximize airflow to the bottom surface of the ice tray.

According to another aspect, the inlet duct may include more than one branch to direct air to the ice tray.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A refrigerator, comprising:

a cabinet;

a refrigeration system including an evaporator; and an ice-making compartment within the cabinet, the ice-making compartment comprising:

a housing defining an inlet aperture on an upper portion of the housing and an outlet aperture, wherein the housing has a stepped top wall;

an ice storage bin positioned in a lower portion of the housing;

an ice tray positioned above the ice storage bin, wherein a space between the stepped top wall and the ice tray decreases with each step from a first end of the ice tray to a second opposing end of the ice tray;

an inlet duct in fluid communication with the inlet aperture and configured to direct air into the housing from the evaporator, wherein the inlet duct includes a first branch having a plurality of first branch channels to direct air to a plurality of first branch locations on a first surface of the ice tray and a second branch to direct air to a second surface of the ice tray; and an outlet duct in fluid communication with the outlet aperture and configured to direct air from the housing to the evaporator.

2. The refrigerator of claim 1, wherein the first surface of the ice tray is a top surface and the second surface of the ice tray is a bottom surface, such that the plurality of first branch channels direct air to the plurality of first branch locations on the top surface.

3. The refrigerator of claim 1, wherein the inlet and outlet apertures are defined by opposing sidewalls of the housing.

4. The refrigerator of claim 1, wherein the plurality of first branch channels are oriented within the housing to direct air from the inlet duct to each ice cube cavity of the ice tray.

5. The refrigerator of claim 4, wherein the steps of the stepped top wall align with the plurality of first branch channels of the inlet duct.

6. The refrigerator of claim 1, wherein the inlet and outlet apertures are defined by a single sidewall of the housing.

7. The refrigerator of claim 1, wherein the stepped top wall has a plurality of steps arranged from proximate the inlet aperture to proximate a sidewall opposing the inlet aperture.

8. The refrigerator of claim 1, wherein a height of a proximal first branch channel of the plurality of first branch channels proximate the inlet duct is greater than a height of a distal first branch channel proximate a sidewall opposing the inlet duct.

9. The refrigerator of claim 1, further comprising:

a dividing wall positioned within the housing, wherein the dividing wall separates the first branch from the second branch.

10. The refrigerator of claim 1, wherein the first branch extends from the inlet aperture and along a top wall of the housing, and wherein the second branch extends from the inlet aperture toward the lower portion of the housing.

11. The refrigerator of claim 1, wherein the upper portion of the housing proximate to the ice tray has a greater depth than the lower portion of the housing proximate to the storage bin.

12. The refrigerator of claim 1, wherein the stepped top wall includes steps arranged from proximate to a first side of the housing that defines the inlet to proximate to a second opposing side of the housing.

13. The refrigerator of claim 1, wherein the first end of the ice tray is a proximal end disposed proximate to the inlet aperture and the second opposing end is a distal end.

14. A refrigerator, comprising:

a cabinet;

a door rotatably coupled to the cabinet; and an ice-making compartment coupled with at least one of the cabinet and the door, wherein the ice-making compartment comprises:

a housing defining an inlet aperture on an upper portion of the housing and an outlet aperture, wherein the housing defines a stepped top wall;

an inlet duct in fluid communication with the inlet aperture and configured to direct air into the housing, wherein the inlet duct includes an upper branch having a plurality of upper branch channels to direct air to a plurality of upper branch locations on a top surface of the ice tray; and an ice tray positioned within the housing proximate to the stepped top wall, wherein the ice tray has a proximal end disposed proximate to the inlet aperture and a distal end, and wherein a space between the stepped top wall and the ice tray decreases with each step from the proximal end to the distal end.

15. The refrigerator of claim 14, wherein the inlet duct includes a lower branch configured to direct air to a bottom surface of the ice tray.

16. The refrigerator of claim 14, wherein the stepped top wall includes multiple steps including a proximal step disposed proximate to a first side of the housing that defines the inlet aperture to a distal step proximate to a second opposing side of the housing, wherein a height of the housing decreases with each step from the proximal step to the distal step.

* * * * *